United States Patent [19]

Danneberg

[11] Patent Number: 4,527,343

[45] Date of Patent: Jul. 9, 1985

[54] PROCESS FOR THE FINISHING AND/OR DRYING OF WASH

[76] Inventor: Jorg Danneberg, Mathildenstrasse 42, D-8500 Nuremberg 20, Fed. Rep. of Germany

[21] Appl. No.: 521,236

[22] Filed: Aug. 8, 1983

[30] Foreign Application Priority Data

Aug. 16, 1982 [DE] Fed. Rep. of Germany ..... 3230764

[51] Int. Cl.[3] ..... F26B 5/04; F26B 3/00; B08B 3/12

[52] U.S. Cl. ..... 34/16; 8/149.3; 34/35; 34/36; 68/5 C

[58] Field of Search ..... 34/16, 35, 36, 37, 38; 8/149.3; 68/5 R, 5 C

[56] References Cited

U.S. PATENT DOCUMENTS

| | | | |
|---|---|---|---|
| 2,567,940 | 9/1951 | Karrer et al. | 34/36 |
| 2,583,286 | 1/1952 | Albini-Colombo | 8/149.3 |
| 2,682,116 | 6/1954 | Dungler | 34/37 |
| 3,270,429 | 9/1966 | Alberto et al. | 34/37 |
| 3,732,628 | 5/1973 | Blevens et al. | 34/32 |
| 3,761,977 | 10/1973 | Rappoport | 8/149.3 |
| 3,804,549 | 4/1974 | Dawson et al. | 8/149.3 |
| 3,895,447 | 7/1975 | Masero et al. | 34/36 |
| 4,242,808 | 1/1981 | Luthi | 34/35 |

FOREIGN PATENT DOCUMENTS

| | | |
|---|---|---|
| 2100116 | 10/1973 | Fed. Rep. of Germany . |
| 2841886 | 9/1978 | Fed. Rep. of Germany . |
| 7911152 | 8/1979 | Fed. Rep. of Germany . |
| 2939870 | 10/1979 | Fed. Rep. of Germany . |

*Primary Examiner*—John J. Camby

*Attorney, Agent, or Firm*—Scully, Scott, Murphy & Presser

[57] ABSTRACT

A process for the finishing and/or drying of wash or laundry through the utilization of steam as an energy carrier medium, and more particularly, a process employing only steam without the addition of air.

17 Claims, 4 Drawing Figures

PROCESS FOR THE FINISHING AND/OR DRYING OF WASH

BACKGROUND OF THE INVENTION

1. Field of the Invention

The present invention relates to a process for the finishing and/or drying of wash or laundry through the utilization of steam as an energy carrier medium, and more particularly, through the use of only steam without the addition of air.

2. Discussion of the Prior Art

German Petty Pat. No. 79 11 152 already discloses an arrangement for the smoothing of clothing articles, especially for the simultaneous drying and smooth finishing of washed clothing articles, including a treatment chamber in the form of a tunnel and a transport arrangement, wherein the clothing articles are treated in a steam zone through the intermediary of steam and air, and in the drying zone by means of hot air.

From German Laid-open patent application No. 28 41 886 there has become known a process for the finishing of washed textile articles constituted of a mixed textile fabric, in which the washed textile articles are subjected subsequent to the washing to steaming in a chamber also containing air components, and are subsequently dried by being exposed to air. In this known process, the textile articles are additionally subjected to hot water preceding the drying. Thereby, during finishing there should be effected not only the removal of ripples and crinkles in the fabric, but in addition thereto, there should also take place the removal or, in effect, smooth finishing of thermo-fixed folds.

In addition thereto, from German Laid-open patent application No. 29 39 817 there is also known an arrangement for the smooth finishing and drying of washed shaped articles from mixed fabrics, wherein the shaped articles are suspended in a moist condition, subjected to a stream of steam in an air-filled chamber, and dried in an air stream. The moist suspended shaped articles are slowly heated at a somewhat constant moisture, and thereafter mechanically smooth finished for a short period under a continual dispersed blown on stream of hot air and in that manner dry-shaped. For this purpose there are provided, in sequence, a steam chamber and a drying chamber. Provided in the wall of the steam chamber are openings for the introduction of steam and concurrently, nozzles for the introduction of hot air, whereas in the wall of the drying chamber there are merely present nozzles for the blowing in of hot air.

The core of the problem which is encountered during the finishing and drying of wash are a rapid heat transport and an ensured penetration of the wash with warmth and moisture up to the interior of the weave and sewing threads which, as is known, represent a fiber bundle.

As has already been mentioned hereinabove, this has heretofore been effected in that warm or hot air or a steam-air mixture is conveyed past the wash articles at a higher or lower speed. Based on commercial considerations, an acceleration of these procedures is extremely desirable. This can be effected through an increase in the temperature. However, such a temperature increase can quite easily lead to an excessive drying, or also to a singeing of the wash articles. Due to this reason, heretofore there had to be always selected a compromise between a rapid treatment of the wash and a possible adverse effect thereon through excessive drying or singeing.

SUMMARY OF THE INVENTION

Accordingly, it is an object of the present invention, while avoiding any adverse influence over the wash or laundry articles which are to be treated, to achieve at a low energy requirement, on the one hand, a good smooth finishing of these wash articles and, on the other hand, a high through-running speed.

The foregoing object pursuant to the invention, is attained through a process as described herein, in that as the energy carrier medium there is utilized merely steam without the addition of air.

The present invention proceeds from the recognition that during the condensation of steam there is suddenly released an extremely high quantity of energy, namely the energy of vaporization, which consists of a multiple of the specific heat of hot air. Thereby, the steam changes its physical condition and converts into the liquid phase (water).

The thus formed moisture is throughout desirable, since it facilitates the energy transport to the innermost regions of the textile fibers. The hot air which has heretofore been utilized for the heat transport is no longer desired in this process. Through its insulating effect it acts in opposition to the rapid heat transport.

The invention is now described hereinbelow in an exemplary manner.

Figure 1:
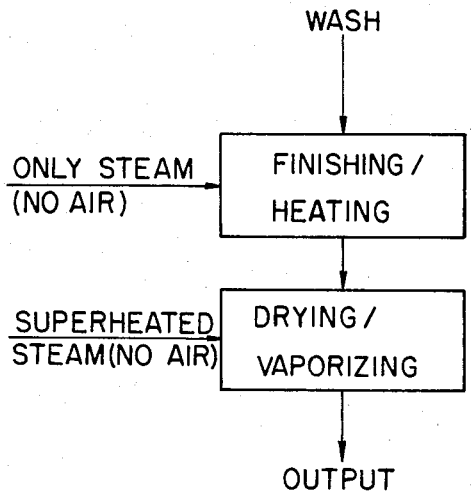
FIG. 1 is a block diagram showing the heating and drying steps of the present invention.
Figure 3:
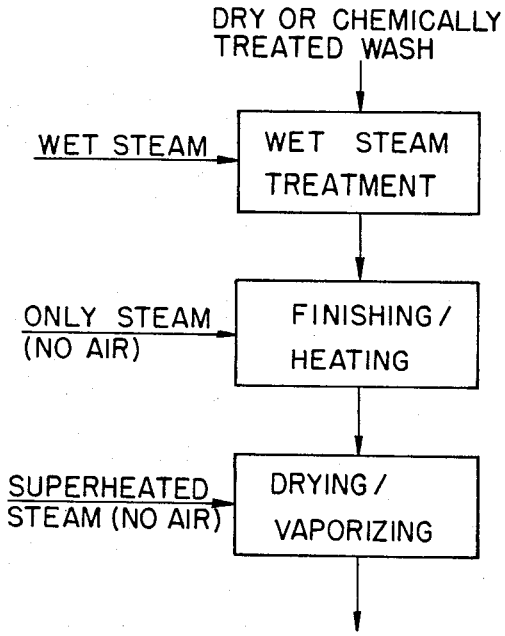
FIG. 3 is a block diagram showing the step of introducing wet steam to the wash before heating.

The finishing and drying of the wash or laundry is effected in two phases as shown in FIG. 1. During the first phase, the heating phase, the wash should be heated as rapidly as possible to about 99° to 100° C. This takes place through the introduction of wet steam (FIG.3), which will initially condense upon impinging against the cooler wash and, thereafter, in the form of heated water and under the influence of the capillary effect will extremely rapidly and intensely penetrate the interstices between the individual fibers with moisture as well as with warmth.

As soon as there can be recognized that the wash has been heated up to about 99° to 100° C., the steam is either superheated in a heat exchanger or, alternately, superheated steam is introduced. The reaching of this threshold can be recognized in that no further steam will now condense, meaning, that the volume of the steam will no longer reduce.

During the subsequent vaporization phase, there is vaporized the original residual moisture of the textile fabric and the moisture which has been additionally formed through condensation of the steam. This occurs through superheated steam, which has a high specific heat content, so that only relatively small masses must be moved, which will also act satisfactorily upon the drive power input.

During the blowing of the superheated steam against the wash, the moisture which is located on and contained in the wash is vaporized causing a certain cooling down of the superheated steam. Hereby, there must be ensured that the superheated steam will not be cooled down to within about the region of the saturated steam, since in such an instance, moisture can no longer be withdrawn from the wash. Advantageously, the steam is hereby circulated by means of a blower. The heat withdrawn therefrom during the vaporization of the water is thereafter again reconveyed thereto through a heat exchanger.

It is decisive that during both phases, the heating phase and the vaporization phase, steam is exclusively employed without the additions of air for the heat transport. Resulting therefrom is an extremely extensive fiber protection. Due to the lack of oxygen there is also avoided the danger of a singeing (oxidation) of the wash. The superheated steam during the vaporization phase allows for relatively high temperatures under extensive protection of the fibers, so that even cotton components of the fibers will not be adversely influenced.

The presence of superheated steam and water during the heating sequence, and the exclusion of air also during the drying sequence, leads to an extremely good finish (wrinkle-free smooth finishing of the wash) at a short drying period. A finishing by means of extensive mechanical stretching in an air stream is not required. By means of the relatively high temperatures which occur during the vaporization phase, there is facilitated a finishing without the mentioned heretofore necessary mechanical stretching in an air stream. The usual measures for a good finishing for a mixed fabric ("washing of mixed fabrics") such as partial loading of the washing machine, washing with a higher water level, "cool down" with high water use, as well as similar measures can be eliminated.

In the treatment of flatwash articles, particularly bed sheets, pillow cases, and so forth, operation can be basically effected pursuant to the same process. Advantageously, the drying sequence is then already terminated at a predetermined residual moisture. The residual moisture is namely required in order to achieve a corresponding surface smooth finishing, for example, in a laundry. The laundry mangle can be arranged interiorly as well as exteriorly of the treatment chamber.

The last-mentioned described process variant is particularly suited for the treatment of wash articles of pure cotton.

Figure 2:
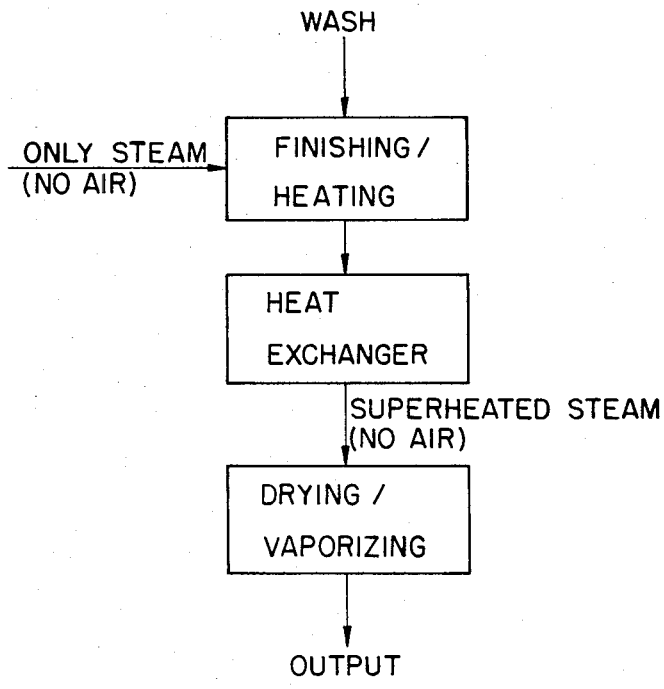
FIG. 2 is a block diagram showing the step of superheating the steam in a heat exchanger.

In the utilization of a single chamber, the latter is initially filled with steam. Due to the higher specific density, any air which is eventually present in the chamber will displace downwardly. Subsequently, the wash is introduced into the single chamber. Naturally, the wash can also be introduced into the single chamber prior to filling the latter with steam. To the extent that, on the basis of the hereinabove described criteria, there is determined that a condensation of the steam no longer takes place within the chamber, meaning, that the wash has reached a temperature of about 99° to 100° C., the steam which is contained in the chamber is superheated either within the chamber by means of a heat exchanger (FIG. 2), or possibly superheated steam is introduced into the chamber.

Instead of the above-described single chamber there can also be employed a rotating drum which is initially filled with steam with concurrent displacement of the air components, and later on filled with superheated steam. Also herein through a heat exchanger, the steam can be superheated at the beginning of the second phase, the vaporization phase, by means of the heat exchanger. Through the superheating of the steam and the therewith attendant simultaneous constant vaporization of the moisture in the wash, during the drying phase there is obtained a constant increase in the steam volume. As soon as an increase in the volume can no longer be determined, this can be evaluated as a sign that the drying sequence of the wash is completed.

Naturally, there can also be arranged in sequence a chamber with steam for the heating phase and a chamber with superheated steam for the drying phase, and locks can be arranged intermediate the two chambers, as well as between the chambers and the outside atmosphere. Herein, the two gates of one of each of the locks are locked with respect to each other so that, presently, only one gate is to be opened and a simultaneous opening of both gates of one lock is prevented. Through a slight excess pressure in the heating chamber, as well as in the vaporization chamber, there is afforded that air cannot enter these chambers. The lock chambers are selected to be so small that during passage through the locks only a relatively small volume can presently escape into the surrounding atmosphere. The air which is carried along during the inlet of the wash can be pared off through a directed spray of steam.

Finally, it is also to be emphasized that the mentioned locks can be completely eliminated when there is selected an essentially completely sealed container which incorporates one or more openings in its lower region, which is filled from above with steam and in which the wash articles are introduced and discharged from below. Because of the lower specific density, the blown-in steam then displaces the air which is located within the container. When it is recognized pursuant to the above-described criteria, that the wash has reached a temperature of about 99° to 100° C. and a condensation of the introduced steam no longer takes place, then there is introduced either superheated steam, or the steam which is present within the container is superheated by means of a heat exchanger. Due to the vaporization of the moisture on and in the wash under the inflow of the superheated steam, the volume of the steam increases quite significantly. Consequently, steam will constantly escape through the lower openings of the container. The entry of air is thus securely prevented. When a significant increase in the steam volume no longer occurs, it can then be assumed that the moisture has been withdrawn out of the wash down to a low residual component. The treatment procedure can then be terminated.

By means of a suitable transport facility, the wash can be introduced upwardly from below and conveyed through the treatment chamber, at such a speed that within the individual zones there is obtained a sufficiently lengthy dwelling period. Any undesirable recontamination, as has been encountered heretofore in all processes which operate with air components, is avoided through the use of only steam. As previously mentioned, a complete closure of the bottom of the container is thereby not required.

In all of the above-described processes, a heat recovery or a direct further use of the excess steam is possible, for example, in machines in the wash area (washing machines). In this manner, energy costs can be held relatively low.

An appreciable acceleration of the process cycle can be achieved in that, during the first time segment of the drying phase, the superheating temperature for the steam is selected to be extremely high, for example, at 220° C. As long as sufficient residual moisture is present in the wash, the fabric temperature will not rise above 100° C. under normal pressure. Towards the end of the drying phase, the temperature is reduced to such an extent that any wash damaging of the fabric is precluded. Already hereinabove it has been illustrated at which point there can be recognized the end of the drying phase.

Figure 4:
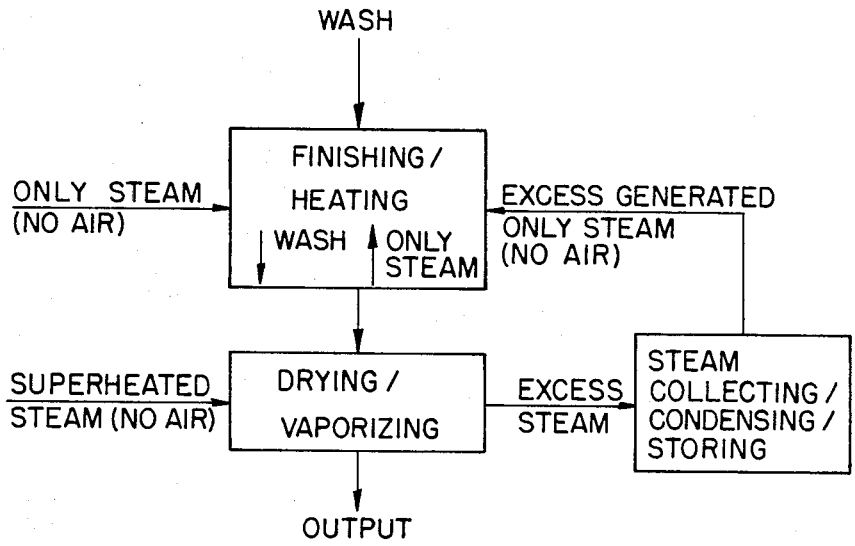
FIG. 4 is a block diagram showing the additional steps of collecting excess steam and utilizing the excess steam for heating.

Through a heat recovery as shown in FIG. 4 there is only further required the energy quantity which is necessary during the heating phase of the wash, in effect, the energy with which the wash goods are heated inclusive the water contained therein from the initial temperature (room temperature) to the final temperature of the heating phase (approximately 100° C.). The energy of vaporization which is subsequently required during the drying phase remains latently contained in the excess steam, and is not lost.

When an immediate further use of the steam is not possible, then the latter can be condensed and, with appropriate thermal insulation, also stored over lengthy periods of time.

What is claimed is:

1. A process for the smooth finishing or the smooth finishing and drying of wash through the utilization of only steam as an energy carrier medium, comprising heating and smoothing the wash with an energy carrier comprising substantially only steam, without air, partially condensing said steam to heated water which penetrates the wash to ensure a rapid heat penetration to the interior weaves of the wash and rapid heating of the wash by the steam, whereby the lack of oxygen in the steam avoids singeing of the wash.

2. Process as claimed in claim 1, comprising utilizing steam without air addition during a first phase for said heating of the wash; and thereafter introducing only superheated steam without air addition during a second phase for the vaporization of the moisture in the wash, said moisture including the heated water from said heating phase and moisture which had been present in the wash prior to heating thereof with only steam, with the superheated steam vaporizing the moisture to make the wash more dry while the lack of oxygen in the superheated steam avoids singeing of the wash.

3. Process as claimed in claim 2, comprising superheating the steam for the second phase through the intermediary of a heat exchanger.

4. Process as claimed in claim 2, comprising utilizing superheated steam during both phases.

5. Process as claimed in claim 2, wherein said process is implemented in a substantially completely closed container having at least one opening in the lower portion for the inlet and discharge of the wash goods, comprising introducing steam into said container during the first phase, and introducing superheated steam during the second phase, and steam or superheated steam displacing any air from said container through said opening.

6. Process as claimed in claim 1, for the continual infeed and discharge of wash to be treated; comprising initially introducing the wash through locks into a first chamber filled with steam; subsequently conveying the wash into a second chamber filled with superheated steam; and then discharging the wash from said second chamber.

7. Process as claimed in claim 1, for the discontinuous treatment of said wash; comprising treating said wash within a single chamber having steam and superheated steam sequentially introduced therein.

8. Process as claimed in claim 2, for the additional disinfection or sterilization of said wash; comprising treating the wash goods during the second phase between 5 and 20 minutes in an atmosphere of superheated steam at about 105° C. to 150° C.

9. Process as claimed in claim 2, for the treatment of dry, chemically cleansed or other wash articles down to a low residual moisture; comprising subjecting the wash to a wet steam treatment preceding the first phase.

10. Process as claimed in claim 1, comprising utilizing elevated operating pressures for accelerating the process.

11. Process as claimed in claim 1, comprising initially imparting a directed stream of wet steam against the wash goods for removal of entrained air from the wash.

12. Process as claimed in claim 2, comprising collecting the quantity of steam additionally generated during the drying phase.

13. Process as claimed in claim 1, comprising conveying the steam volume in counterflow past the wash goods being treated.

14. Process as claimed in claim 7, comprising collecting, condensing and storing the additional quantity of steam generated during the drying phase.

15. Process as claimed in claim 14, comprising subsequently utilizing the excess generated steam for heating purposes.

16. Process as claimed in claim 2, comprising operating during the first portion of the drying phase with the superheated steam at a temperature above 140° C.

17. A process for smooth finishing and drying wash comprising:

heating and smoothing the wash in a first phase with an energy carrier comprising substantially only steam, without air, partially condensing said steam to heated water which penetrates the wash to ensure a rapid heat penetration to the interior weaves of the wash and rapid heating of the wash by the steam, whereby the lack of oxygen in the steam avoids singeing of the wash; and drying the wash in a second phase by introducing only superheated steam without air addition during a second phase for the vaporization of the moisture in the wash, said moisture including the heated water from said heating phase and moisture which has been present in the wash prior to heating thereof with only steam, with the superheated steam vaporizing the moisture to make the wash more dry while the lack of oxygen in the superheated steam avoids singeing of the wash.

* * * * *